United States Patent [19]

Huang

[11] Patent Number: 5,056,660

[45] Date of Patent: Oct. 15, 1991

[54] STRUCTURE OF MUSIC GIFT BOX

[76] Inventor: Andy Huang, No. 11, Lane 37, Sec. 4, Chung Yang Road, Tucheng Hsiang, Taipei, Taiwan

[21] Appl. No.: 565,391

[22] Filed: Aug. 10, 1990

[51] Int. Cl.[5] ..... G09F 25/00; G10F 1/00

[52] U.S. Cl. ..... 206/232; 40/124.1; 40/902; 84/2; 206/455; 206/39

[58] Field of Search ..... 40/124.1, 155–157, 40/455, 459, 902; 63/19; 84/2, 94.2, 95.1, 95.2, 170; 206/223, 232, 449, 39, 455; 446/81, 404

[56] References Cited

U.S. PATENT DOCUMENTS

| | | | |
|---|---|---|---|
| 3,798,806 | 3/1974 | Sanford | 40/455 |
| 4,102,067 | 7/1978 | Tarrant | 40/455 |
| 4,222,188 | 9/1980 | Tarrant et al. | 40/455 |
| 4,607,747 | 8/1986 | Steiner | 206/232 |
| 4,611,262 | 9/1986 | Galloway et al. | 206/232 |

FOREIGN PATENT DOCUMENTS

| | | | |
|---|---|---|---|
| 1020967 | 2/1953 | France | 84/95.2 |

*Primary Examiner*—Jimmy G. Foster

*Attorney, Agent, or Firm*—Lowe, Price, LeBlanc & Becker

[57] ABSTRACT

A music gift box includes a pair of shells pivotally connected together. A cover board is mounted within one of the shells and carries a circuit board, a DC power supply, a speaker and a frame for holding a picture. When the gift box is closed, the circuit board is disconnected from the power supply. When the gift box is opened, the working voltage actuates the circuit board to produce music through the speaker.

2 Claims, 3 Drawing Sheets

STRUCTURE OF MUSIC GIFT BOX

BACKGROUND OF THE INVENTION

The present invention relates to gift boxes and, more particularly, to a music gift box which produces music when opened.

A gift box is an ornamental container designed for holding giftware. The ornamental shape of such gift boxes is often insufficent to attract consumers.

It is accordingly one object of the present invention to combine a picture frame, a gift box and a music box into a solid unit.

SUMMARY OF THE INVENTION

The music gift box of the present invention comprises two pivotally connected shells of ornamental shape with a cover board mounted to within one of the shells. The cover board has a circuit board, a DC power supply and speaker mounted thereto and a window for holding a picture. When the gift box is closed, the circuit board is disconnected from the DC power supply. As soon as the gift box is opened, a DC working voltage actuates the circuit board to produce music through the speaker.

BRIEF DESCRIPTION OF THE DRAWINGS

The present invention will now be described by way of examples with reference to the annexed drawings, in which.

DETAILED DESCRIPTION OF THE PREFERRED EMBODIMENT

Figure 1:
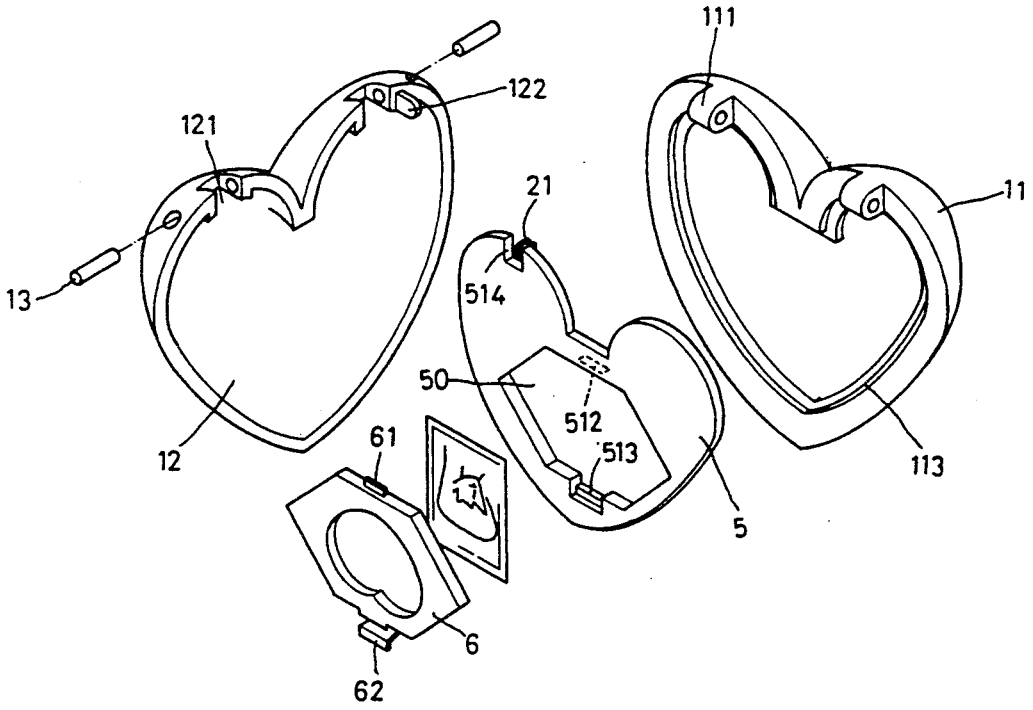
FIG. 1 is a perspective fragmentary view of a music gift box according to the present invention.
Figure 2:
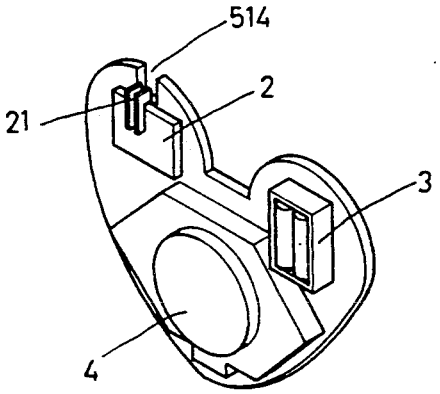
FIG. 2 is a schematic drawing, in which circuit board and battery holder are mounted on the cover board.
Figure 3:
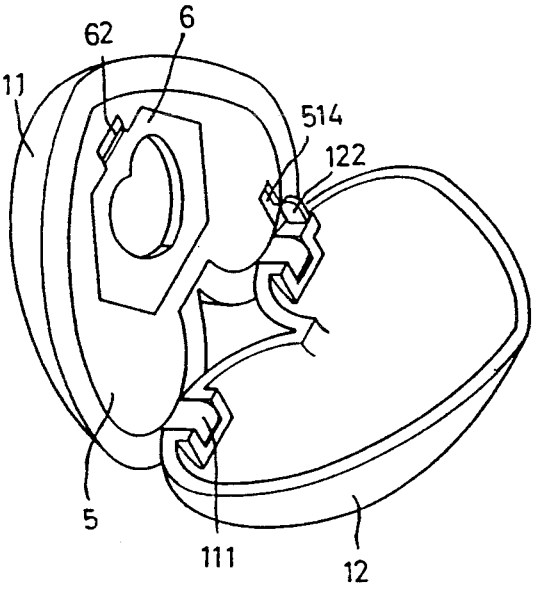
FIG. 3 is a perspective assembly view of the music gift box in an opened condition.

The music gift box embodying the present invention generally comprises a box of predetermined shape containing a cover board 5 having a circuit board 2, a battery holder 3, a speaker 4, and a window 6.

The box comprises two heart-shaped, opposite shells 11, 12 pivotally connected together. The first shell 11 is formed with two lugs 111 adapted to engage two notches 121 on second shell 12. During assembly, the lugs 111 are inserted in the notches 121 and respectively fastened with two lock pins 13. An internal groove 113 extends along the periphery of the bottom surface of the first shell 11 to receive the cover board 5. A projecting strip 122 on the second shell 12 is located to trigger a contact switch 21 on the circuit board 2 when the shells are opened.

The circuit board 2 is mounted on the cover board 5 and the contact switch 21 is exposed to the strip 122 in a notch 514 on the cover board 5 so that the switch is constantly pressed by the projecting strip 122 shell 12 when the shells are closed to cut off the power supply. When the shells are opened, i.e., the second shell 12 is rotated through a certain angle relative to the first shell 11, the projecting strip 122 is released from the contact switch 21 permitting the circuit board 2 to be electrically connected to produce music through the speaker 4.

The battery holder 3 is mounted on the cover board 5 to hold dry batteries and is connected to the contact switch 21 to provide the circuit board 2 with a working voltage when the contact switch 21 is actuated in the manner described above.

The speaker 4 is also mounted on the cover board 5 at a suitable location and connected with the circuit board 2 for audio signal output.

The cover board 5 is a flat plate dimensioned to fit within the peripheral groove 113 so that it can be set in the first shell 11. As described above, the circuit board 2, the battery holder 3 and the speaker 4 are respectively mounted on the cover board 5 and controlled by the projecting strip 122 of the second shell 12 to produce music. There is a recessed area 50 in the cover board 5 having, a mortise 512 and a notch 513 at two opposite locations thereof for mounting the frame or window 6 containing a picture in the recessed area.

The window 6 is dimensioned as to fit in the recessed area 50 of the cover board 5, and has an opening of predetermined shape at the center thereof through a picture which is mounted for display in the recessed area 50 of the cover board 5. The window 6 has a stub tenon 61 and a resilient projecting strip 62 respectively for fastening in the mortise 512 and the notch 513 to permit the window 6 to be fixed in the cover board 5.

Assembly of the afore-said parts into a music gift box is outlined below. After the circuit board 2, the battery holder 3 and the speaker 4 are respectively mounted on the cover board 5 with the contact switch 21 of the circuit board 2 fastened in the notch 514 of the cover board 5, the cover board is fastened in the internal, peripheral groove 113 of the first shell 11. A picture is placed in the recessed area 50 of the cover board 5 and the window 6 is fastened in the recessed area to secure the picture therein, with stub tenon 61 and resilient projecting strip 62 respectively fastened in the mortise 512 and the notch 513 of the cover board 5. The lugs 111 of the first shell 11 are then respectively fastened in the notches 121 of the second shell 12 and secured thereto with the lock pins 13 permitting the second shell 12 to pivot on the first shell 11.

When the first and second shells 11, 12 are closed, the projecting strip 122 is forced to press on the contact switch 21 of the circuit to stop its operation. When the second shell 12 is rotated through a certain angle (preferably 60° relative to the first shell 11), the projecting strip 122 is released from the contact switch 21, permitting the dry batteries inside the battery holder 3 to provide a working voltage to the circuit board 2 to trigger the speaker 4 to produce music.

What is claimed is:

1. A music gift box, comprising:

a box of predetermined shape, including a first shell and a second shell and means for pivotally connecting the shells together, said second shell having a projecting strip extending toward said first shell;

a cover board mounted on said first shell, said cover board having a recess and means mounted to the recess for holding a picture in the recess for display, said cover board further including a circuit board, a battery holder and a speaker mounted thereon, said circuit board having a contact switch respectively connected to said battery holder and said speaker;

wherein said projecting strip of said second shell is positioned to press said contact switch to stop the operation of said circuit board when said first and second shells are closed together; said projecting strip of said second shell being released from said contact switch permitting said circuit board to produce music for output through said speaker when said second shell is opened relative to said first shell.

2. The music gift box of claim 1, further including a groove formed in the periphery of the first shell for receiving the cover board therein.

* * * * *